US011421949B2

(12) United States Patent
Holdenried et al.

(10) Patent No.: US 11,421,949 B2
(45) Date of Patent: Aug. 23, 2022

(54) FLAT TUBE FOR AN EXHAUST GAS COOLER

(71) Applicant: Mahle International GmbH, Stuttgart (DE)

(72) Inventors: Jens Holdenried, Ditzingen (DE); Achim Herber, Vaihingen (DE); Steffen Brunner, Weissach im Tal (DE)

(73) Assignee: Mahle International GmbH

( * ) Notice: Subject to any disclaimer, the term of this patent is extended or adjusted under 35 U.S.C. 154(b) by 118 days.

(21) Appl. No.: 16/228,225

(22) Filed: Dec. 20, 2018

(65) Prior Publication Data

US 2019/0195575 A1 Jun. 27, 2019

(30) Foreign Application Priority Data

Dec. 21, 2017 (DE) ..... 102017223616.7

(51) Int. Cl.
*F28F 13/12* (2006.01)
*F28F 1/02* (2006.01)
(Continued)

(52) U.S. Cl.
CPC ..... *F28F 13/12* (2013.01); *F28D 21/0003* (2013.01); *F28F 1/02* (2013.01);
(Continued)

(58) Field of Classification Search
CPC ..... F28D 21/0003; F28D 2021/008; F28F 13/12; F28F 1/02; F28F 1/426; F28F 2001/027; F28F 1/06; F28F 1/42
See application file for complete search history.

(56) References Cited

U.S. PATENT DOCUMENTS 2,181,927 A * 12/1939 Townsend ..... F28F 1/02 165/147
3,157,229 A * 11/1964 Wennerberg ..... F28F 21/067 165/167
(Continued)

FOREIGN PATENT DOCUMENTS

CN 101033925 A 9/2007
CN 201302409 Y 9/2009
(Continued)

OTHER PUBLICATIONS

Chinese Office Action dated Jan. 4, 2022 for copending Chinese Appl. No. 201811533742.5 (with English translation).
(Continued)

*Primary Examiner* — Ljiljana V. Ciric
(74) *Attorney, Agent, or Firm* — Fishman Stewart PLLC

(57) ABSTRACT

A flat tube for an exhaust gas cooler including two flat wide sides and two rounded narrow sides. The flat tube further including a plurality of moulded turbulence projections arranged on the two wide sides in two flow rows and projecting from a respective one of the two wide sides toward the other of the two wide sides. The plurality of turbulence projections are respectively structured in an elongated manner and arranged at an angle relative to a longitudinal direction. The flat tube also including a plurality of moulded support projections projecting from a respective one of the two wide sides away from the other of the two wide sides. The plurality of support projections are arranged between the two flow rows. The two narrow sides each have an elongated flat region that merges into the two wide sides via a plurality of rounded corner regions.

20 Claims, 5 Drawing Sheets

(51) Int. Cl.
*F28D 21/00* (2006.01)
*F28F 1/42* (2006.01)

(52) U.S. Cl.
CPC ..... *F28F 1/426* (2013.01); *F28D 2021/008* (2013.01); *F28F 2001/027* (2013.01)

(56) References Cited

U.S. PATENT DOCUMENTS 3,757,855 A * 9/1973 Kun ..... F28D 1/0391 165/166
3,757,856 A * 9/1973 Kun ..... B21D 53/04 165/166
3,810,509 A * 5/1974 Kun ..... F28D 9/00 165/148
4,024,623 A * 5/1977 Kun ..... B21D 22/04 76/107.1
4,119,144 A * 10/1978 Kun ..... B21D 22/04 165/175
5,175,975 A * 1/1993 Benson ..... F28F 1/02 52/788.1
5,369,883 A * 12/1994 So ..... F28D 9/0043 29/890.039
5,441,105 A * 8/1995 Brummett ..... F28D 1/0316 165/153
5,538,077 A * 7/1996 So ..... F28F 9/0234 165/109.1
5,730,213 A * 3/1998 Kiser ..... F28D 1/05383 165/109.1
5,768,782 A * 6/1998 Kato ..... B21C 37/151 29/890.053
5,996,633 A * 12/1999 Kato ..... F28D 1/0316 138/38
6,209,629 B1 * 4/2001 Halt ..... F28D 1/0333 165/148
6,286,201 B1 * 9/2001 Prater ..... B21C 37/0803 29/727
6,453,988 B1 * 9/2002 Nakado ..... F28D 1/0391 165/152
6,470,964 B1 * 10/2002 Nakado ..... F28D 1/0391 165/133
6,698,509 B2 * 3/2004 Rong ..... F28D 1/0341 165/153
6,935,418 B1 * 8/2005 Valaszkai ..... F28F 1/022 165/109.1
6,938,685 B2 * 9/2005 Duerr ..... F28D 1/0333 165/148
6,997,248 B2 * 2/2006 Shabtay ..... F28D 1/05333 165/153
7,055,586 B2 * 6/2006 Sakakibara ..... F28D 7/1684 138/38
7,610,949 B2 * 11/2009 Palanchon ..... F28D 9/0043 165/103
7,618,598 B2 * 11/2009 Reinke ..... B01J 19/249 422/198
7,661,415 B2 * 2/2010 Nakamura ..... F28D 9/0025 123/568.12
7,857,039 B2 * 12/2010 Nakamura ..... F02M 26/32 165/157
7,934,541 B2 * 5/2011 Park ..... F28F 9/0282 165/153
8,235,098 B2 * 8/2012 Agee ..... F28D 7/1684 165/148
8,267,163 B2 * 9/2012 Stewart ..... F28D 1/05366 165/177
9,243,851 B2 * 1/2016 Viswanathan ..... F28F 1/02
10,520,261 B2 * 12/2019 Brunner ..... F28F 1/40
2005/0081379 A1 * 4/2005 Askani ..... F28D 1/0535 29/890.053
2006/0201665 A1 * 9/2006 Yu ..... B21C 37/158 165/177
2007/0107882 A1 5/2007 Geskes et al.
2007/0209788 A1 9/2007 Jing et al.
2009/0188655 A1 * 7/2009 Agee ..... F28F 1/02 165/157
2012/0067557 A1 3/2012 Geskes et al.
2015/0247680 A1 9/2015 Brunner et al.
2017/0205153 A1 * 7/2017 Hermida Dom Nguez ..... F28D 21/0003
2018/0017024 A1 * 1/2018 Hermida Dominguez ..... F28F 3/046
2020/0049413 A1 * 2/2020 Ojiro ..... F28D 9/0037

FOREIGN PATENT DOCUMENTS

CN 201514141 U 6/2010
CN 202582316 U 12/2012
DE 102004045923 A1 5/2005
DE 102012217333 A1 3/2014
EP 2267393 A2 12/2010
EP 1682842 B1 6/2014
GB 2 090 651 A * 7/1982
WO 2017140851 A1 8/2017

OTHER PUBLICATIONS

English abstract for CN201514141.
English abstract for CN201302409.
English abstract for CN202582316.
Chinese Office Action dated Mar. 3, 2021 for copending Chinese Appl. No. 201811533742.5.
Chinese Office Action dated Apr. 8, 2022 for copending Chinese App. No. 201811533742.5 (with machine English translation).
Excerpt from "Petroleum refinery equipment", edited by Sinopec Beijing Design Institute, Sinopec publishing house, pp. 293-294, Jun. 1, 2001 (referred to as E4 in the Chinese Office Action dated Apr. 8, 2022).

* cited by examiner

FLAT TUBE FOR AN EXHAUST GAS COOLER

CROSS-REFERENCE TO RELATED APPLICATION

This application claims priority to German Application No. DE 10 2017 223 616.7, filed on Dec. 21, 2017, the contents of which are hereby incorporated by reference in its entirety.

TECHNICAL FIELD

The invention relates to a flat tube for an exhaust gas cooler, in particular for a motor vehicle.

BACKGROUND

In a motor vehicle, a hot exhaust gas from the diesel engine is usually cooled in an exhaust gas cooler and admixed to the intake air in order to reduce the pollutant quantity—in particular the quantity of nitrogen oxides—in the exhaust gas. Here, a generic exhaust gas cooler comprises a tube bundle of multiple flat tubes for the hot exhaust gas, which on both sides open into a tube sheet. Here, the flat tubes can be rectangular or rounded and have two wide sides located opposite and two narrow sides located opposite in each case. A coolant flows about the flat tubes and absorbs the heat of the hot exhaust gas, as a result of which the hot exhaust gas is cooled. Here, rectangular flat tubes have a higher pressure stability than rounded flat tubes even in the case of large production tolerances. By contrast, the exhaust gas coolers with rounded flat tubes have a lower coolant requirement for preventing boiling.

The efficiency of the diesel engine decreases with the rising temperature of the recirculated exhaust gas. From the prior art, different solutions for increasing the cooling output of the exhaust gas cooler and thereby the efficiency of the diesel engine are already known. Accordingly, rectangular flat tubes are described in EP 2 267 393 B1, WO 2017/140851 A1 and EP 1 682 842 B1, in which multiple turbulence projections—so-called winglets—projecting into the flat tube are moulded onto the wide sides. By way of the turbulence projections, the exhaust gas in the flat tube—a so-called winglet tube—is mixed and because of this also cooled better. In addition, an unobstructed exhaust gas flow through the flat tube can also be prevented along the narrow sides. Disadvantageously, the turbulence projections cannot reach too closely to the rounded narrow sides or too closely to the lateral edge of the flat tube as with a rectangular flat tube, since the turbulence projections can only be stamped in flat regions of the flat tube. In order to nevertheless achieve a comparable cooling output of the exhaust gas cooler, additional lateral projections—as described in DE 10 2012 217 333 A1—can be stamped into the rounded narrow sides.

Usually, the flat tube is produced from a stamped flat tube strip, wherein the flat tube strip comprises a first wide side, a first narrow side, a second wide side, a first part of a second narrow side and a second part of the second narrow side. The first part of the second narrow side adjoins the first wide side and the second part of the second narrow side adjoins the second wide side. During the production, the flat tube strip is folded along the first narrow side so that the first part and the second part of the second narrow side lie against one another. The two parts of the second narrow side are then fixed to one another in a firmly bonded manner—for example by laser welding. A connecting seam then connects the two parts of the second narrow side to the respective second narrow side. The rectangular flat tubes are easier to produce and also have a higher pressure stability at the connecting seam even with large manufacturing tolerances, the flat tubes that are rounded on the narrow sides are more involved in the manufacture, since in particular an accurate arranging of the rounded parts of the narrow sides relative to one another is very complex.

SUMMARY

The object of the invention therefore is to state an improved or at least alternative embodiment for a rounded flat tube of the generic type, with which the described disadvantages are overcome.

According to the invention, this object is solved through the subject of the independent claim(s). Advantageous embodiments are subject of the dependent claim(s).

A generic flat tube for an exhaust gas cooler, in particular for a motor vehicle, comprises two flat wide sides and two rounded narrow sides, which in each case in parallel and located opposite one another. In the wide sides, multiple turbulence projections projecting into the flat tubes are moulded, which are elongated and have an angle to the longitudinal direction of the flat tube. The multiple turbulence projections on the wide sides are arranged in two flow rows that are parallel to the longitudinal direction of the flat tube, between which multiple support projections projecting out of the flat tube are moulded. According to the invention, the respective narrow side has an elongated flat region which, via rounded corner regions of the respective narrow side, merges into the wide sides. Here, the flat region extends in the longitudinal direction of the flat tube and perpendicularly to the two wide sides, and is arranged in the middle or the respective narrow side relative to the two wide sides.

The rounded corner region of the respective narrow sides consequently merges into the flat region, which is orientated in the middle in the respective narrow sides and in the longitudinal direction. Here, the narrow side is formed from two corner regions and the flat region connecting the corner regions. Here, the flat tube can be produced from a flat tube strip which comprises the first wide side, the first narrow side, the second wide side and the second narrow side. The second narrow side is divided in the longitudinal direction on the flat region and the flat tube strip then has a corner region each and a flat region part of the second narrow side each. During the production, the flat tube strip can be folded together along the flat region of the first narrow side and the two flat region parts of the second narrow side arranged against one another because of this. Following this, the two flat region parts of the second narrow side can be fixed to one another in a firmly bonded manner—for example by laser welding. A connecting seam then connects the two flat region parts of the second narrow side in a firmly bonded manner to the flat region, so that the two narrow sides in each case are formed from the flat region and the corner regions lying against the flat region on both sides. By way of the flat region parts of the second narrow side, producing the rounded flat tube can be substantially simplified. Furthermore, the flat tube according to the invention has a high pressure stability even with large production tolerances, since in contrast with a conventional rounded flat tube when the second narrow side is subjected to an interior pressure loading through the exhaust gas, the maximum stress is not applied to the connecting seam of the second narrow side. A length of the respective flat region can correspond to a length of the narrow side. A width of the respective flat region extending perpendicular to the two wide sides can be between 0.5 mm and 0.9 mm, preferably between 0.65 mm and 0.75 mm.

In a further development of the flat tube according to the invention it is provided that in the wide sides, nub-like mouldings projecting into the flat tube are moulded, which in each case are arranged between the two flow rows of the turbulence projections and in each case in the longitudinal direction of the flat tube in a row one behind the other. The nub-like mouldings project into the flat tube and lie between the two flow rows of the turbulence projections. The nub-like mouldings project into the flat tube and lie between the two flow rows of the turbulence projections. In this way, the flow cross section of a flow passage between the two flow rows of the turbulence projections in the flat tube can be reduced. In particular, the exhaust gas cannot flow through the flow passage without obstruction and is therefore cooled better. A substantially semi-spherical base of at least some of the nub-like mouldings can have a diameter between 0.5 mm and 2 mm, preferably between 0.8 mm and 1.5 mm. Furthermore, at least some of the nub-like mouldings can have a depth between 0.5 mm and 1.8 mm, preferably between 1.0 mm and 1.5 mm. The cooling output in the flat tube with the nub-like mouldings roughly corresponds to the cooling output in a rectangular flat tube even without lateral projections projecting into the narrow sides. The flat tube can be produced in a simpler manner and the advantages of the rounded flat tube—such as for example a lower coolant requirement for preventing boiling in the exhaust cooler—are retained.

Advantageously it can be provided that the row of the nub-like mouldings in the one wide side and the row of the nub-like mouldings in the other wide side are located opposite. Here, at least some of the nub-like mouldings in the one row alternative with at least some of the nub-like mouldings in the other row in the longitudinal direction. In this way, the nub-like mouldings in the one wide side and the nub-like mouldings in the other wide side alternatingly conduct the flowing exhaust gas onto one another. In the process, too severe a local cross-sectional reduction of the flow passage between the two flow rows of the turbulence projections and too severe a pressure loss in the flat tube are avoided. Advantageously, the cooling output is retained. Furthermore it can be provided that the nub-like mouldings and the support projections are arranged in a row. The row of the nub-like mouldings and of the support projections can be arranged in the middle in the respective wide side relative to the two narrow sides. In this way, the respective wide side can also be moulded symmetrically to the longitudinal direction.

Advantageously, a base of the turbulence projections can have a length between 3.5 mm and 8 mm, preferably between 5 mm and 6 mm. Alternatively or additionally, the turbulence projections can have a depth between 0.5 mm and 1.8 mm, preferably between 1.4 mm and 1.6 mm. Advantageously, the angle of the turbulence projections to the longitudinal direction of the flat tube can be between 18° and 31°, preferably between 22° and 25°. Consequently, the turbulence projections can be moulded longitudinally and by the angle to the longitudinal direction of the flat tube conducts the exhaust gas in the flat tube also transversely to the longitudinal direction. In this way, the flow of the exhaust gas through the flat tube can be specifically influenced and by way of this the cooling output of the exhaust gas cooler increased.

It can also be provided that the turbulence projections in the respective wide side are arranged in the longitudinal direction into at least one x-shaped arranged and into at least one o-shaped arrangement. The x-shaped arrangement and the o-shaped arrangement are symmetrical to the longitudinal direction so that the exhaust gas in the flat tube can be conducted symmetrically to the longitudinal direction. The x-shaped arrangement conducts the exhaust gas in an inflow direction first half of the narrow sides into the middle of the flat tube and in an inflow direction second half out of the middle to the narrow sides. The o-shaped arrangement conducts the exhaust gas in an inflow direction first half from the middle of the flat tube to the narrow sides and in an inflow direction second half from the narrow sides into the middle of the flat tube. In this way, the exhaust gas can be specifically conducted in the flat tube and the cooling output of the exhaust gas cooler increased.

Advantageously, the x-shaped arrangements and the o-shaped arrangements on the respective wide side can alternate in the longitudinal direction. Furthermore, the x-shaped arrangement can be located opposite the one wide side of the o-shaped arrangement of the other wide side. In this way, an excessive local cross-sectional reduction of the flat tube between the wide sides and an excessive pressure loss in the flat tube are avoided, while the cooling output is advantageously retained. The support projections can then be arranged in the o-shaped arrangement of the respective wide side.

Advantageously, the flat tube can be flow-symmetrically designed, wherein the one wide side corresponds to the other wide side that is perpendicularly mirrored (i.e., non-reversed mirrored, flip mirrored, etc.) relative to the longitudinal direction. By way of this, producing the exhaust gas cooler can be simplified in particular since no additional orientation of the flat tube is necessary. The flat tube can have a width between 13 mm and 18 mm, preferably between 15 mm and 17 mm. Alternatively or additionally, a height of the flat tube can be between 3.8 mm and 5 mm, preferably between 4 mm and 4.6 mm. Furthermore, flat tube can have a wall thickness between 0.35 mm and 0.5 mm, preferably between 0.37 mm and 0.42 mm.

Altogether, the flat tube according to the invention can be produced in a simplified manner and has a high pressure stability even with large manufacturing tolerances. Through the nub-like mouldings in the flat tube, the flow cross section of the flow passage between the two flow rows of the turbulence projections can be reduced, furthermore. In particular, unobstructed flowing through of the exhaust gas can thereby be prevented and the cooling output of the exhaust gas cooler be increased even without lateral projections in the narrow side that are expensive to produce. At the same time, the advantages of the rounded flat tube—such as for example a lower coolant requirement for preventing boiling in the exhaust gas cooler—are retained.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

It shows, in each case schematically

DETAILED DESCRIPTION

Figure 1:
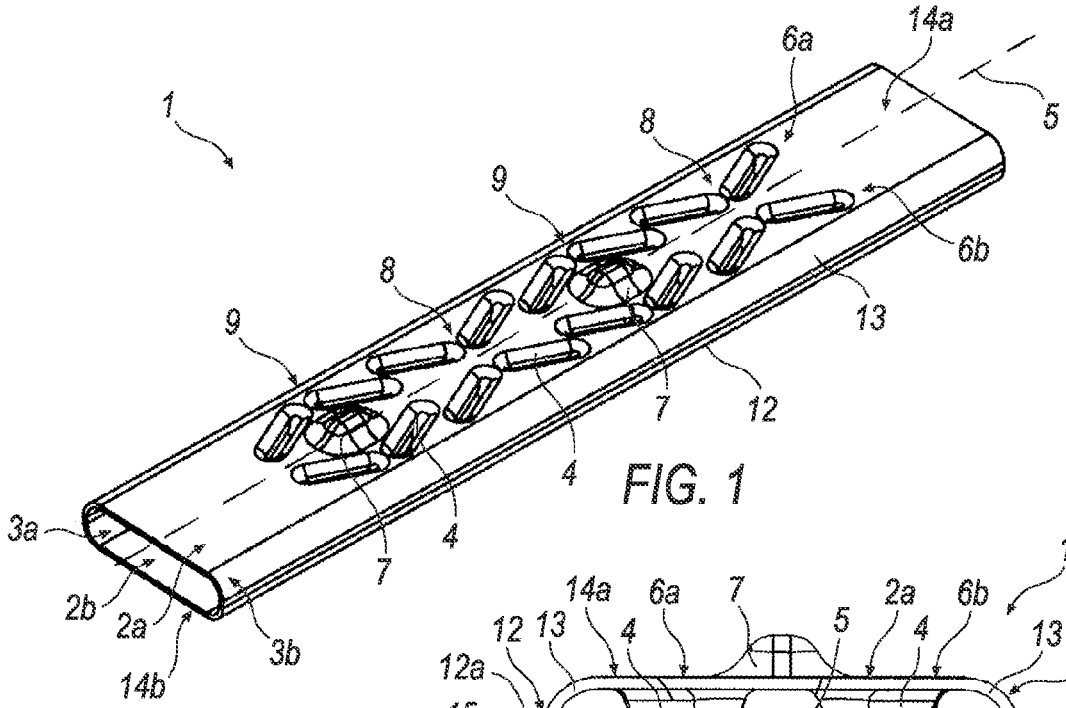
FIG. 1 shows a perspective view of a flat tube according to the invention.
Figure 2:
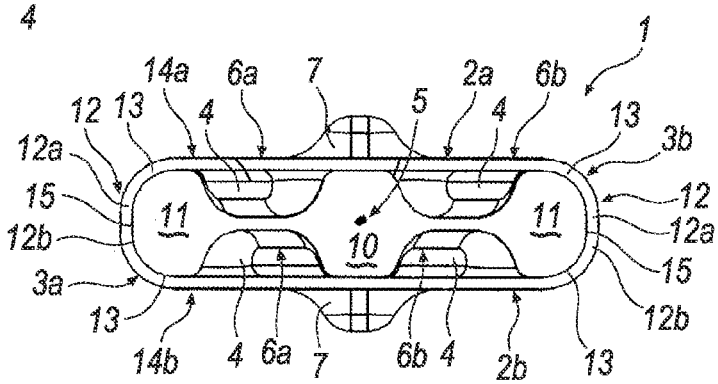
FIG. 2 shows a frontal view of the flat tube shown in FIG. 1.
Figure 3:
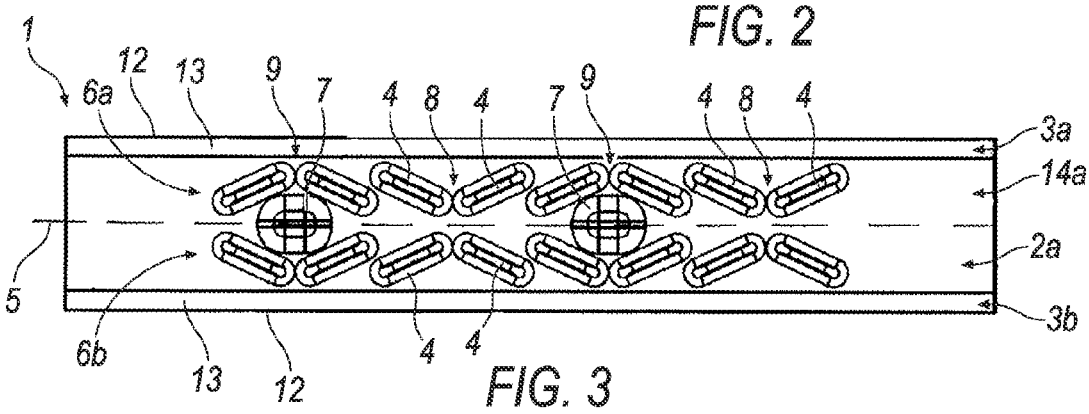
FIG. 3 shows a plan view of the flat tube shown in FIG. 1.
Figure 4:
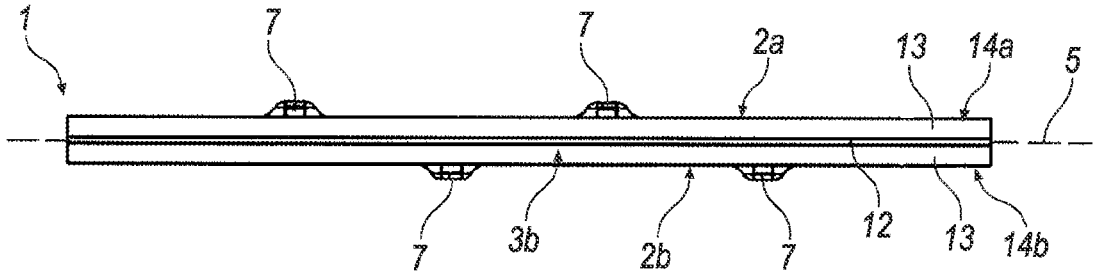
FIG. 4 shows a lateral view of the flat tube shown in FIG. 1.

FIG. 1 shows a view of a flat tube 1 according to the invention. The flat tube 1 is suitable for an exhaust gas cooler, in particular for a motor vehicle. The flat tube 1 may comprise a central longitudinal axis extending in a longitudinal direction 5, two flat and/or planar wide sides 2*a* and 2*b* arranged opposite one another, as well as two rounded narrow sides 3*a* and 3*b* arranged opposite one another. The two rounded narrow sides 3*a*, 3*b* may be narrower than the two wide sides 2*a*, 2*b*. In the wide sides 2*a* and 2*b*, multiple turbulence projections 4 projecting into the flat tube 1 are moulded, which are arranged on the wide sides 2*a* and 2*b* in two flow rows 6*a* and 6*b* that are parallel to the longitudinal direction 5 of the flat tube 1. In an exhaust gas cooler—not shown here, the flat tubes 1 are stacked spaced on top of one another, for the purpose of which multiple support projections 7 projecting out of the flat tube 1 are moulded between the two flow rows 6*a* and 6*b*. In the wide sides 2*a* and 2*b*, the turbulence projections 4 are arranged into x-shaped arrangements 8 and into 0-shaped arrangements 9, which are formed symmetrically to the longitudinal direction 5. By way of this, a symmetrical flow pattern in the flat tube 7 can be achieved in particular. Here, the support projections 7 are arranged in the o-shaped arrangements of the respective wide side 2*a* and 2*b*. Between the two flow rows 6*a* and 6*b*, a middle flow passage 10 and on the narrow sides 2*a* and 2*b* two lateral narrow side passages 11 are formed, as shown in FIG. 2.

The narrow sides 3*a* and 3*b* each have an elongated flat region 12 (e.g., a planar region), which via rounded corner regions 13 of the respective narrow sides 3*a* and 3*b* merges into the wide sides 2*a* and 2*b*. Here, the flat region 12 extends in the longitudinal direction 5 of the flat tube 1 and is arranged perpendicularly to the two wide sides 2*a* and 2*b* in the middle of the respective narrow sides 3*a* and 3*b*. A length of the respective flat region 12 corresponds to a length of the narrow sides 3*a* or 3*b* respectively to a length of the flat tube 1. The respective narrow sides 3*a* and 3*b* are consequently formed of the corner regions 13 and the flat region 12 connecting the corner regions 13. The flat tube 1 is produced from a stamped flat tube strip 14, wherein the flat tube strip 14 comprises the wide sides 2*a* and 2*b*, the narrow side 3*a* and on both sides a corner region 13 each and in each case a flat region part 12*a* or 12*b* of the narrow side 3*b*, as shown in FIG. 2.

During the manufacture, the flat tube strip 14 is folded together on the narrow side 3*a* along the flat region 12 and the two flat region parts 12*a* and 12*b* of the narrow side 3*b* are fixed to one another in a firmly bonded manner—for example welded. A connecting seam 15 then connects the two flat region parts 12*a* and 12*b* in a firmly bonded manner to form the flat region 12, so that the narrow side 3*b* is formed of the flat region 12 and the corner regions 13 lying against the flat region 12 on both sides. The flat region parts 12*a* and 12*b* of the narrow side 3*b* substantially simplify the production of the flat tube 1. Furthermore, the flat tube 1 according to the invention has a high pressure stability even with large manufacturing tolerances, since in contrast with a conventional rounded flat tube the stress, during an internal pressure loading of the narrow side 3*b* by the exhaust gas, does not lie on the connecting seam 15 of the narrow side 3*b*.

Figure 5:
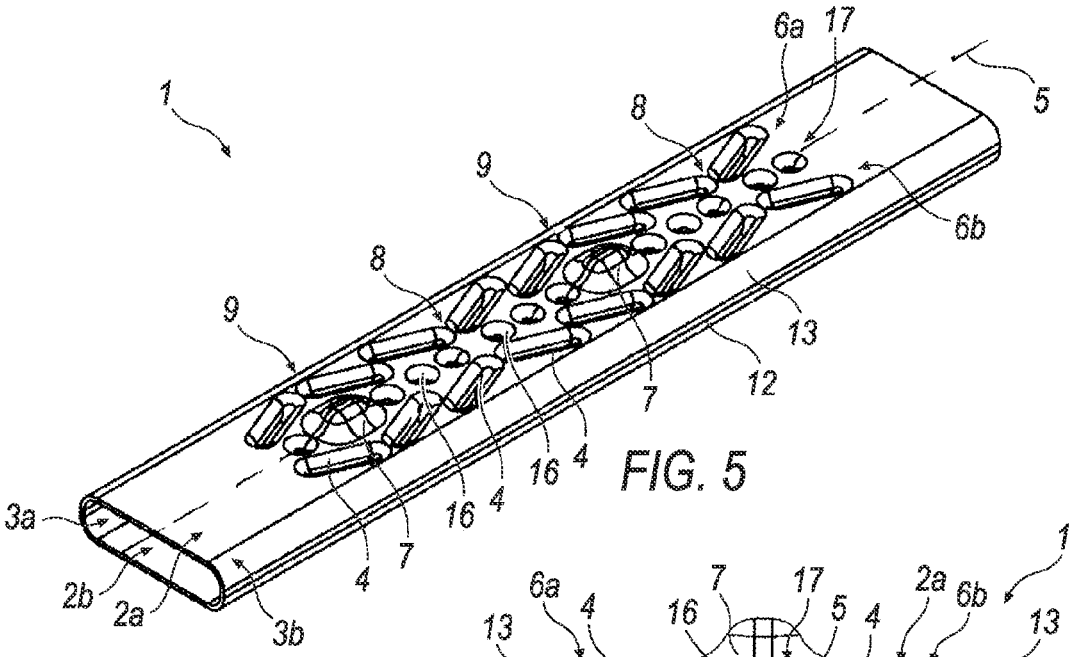
FIG. 5 shows a perspective view of a flat tube according to the invention with multiple nub-like mouldings.
Figure 6:
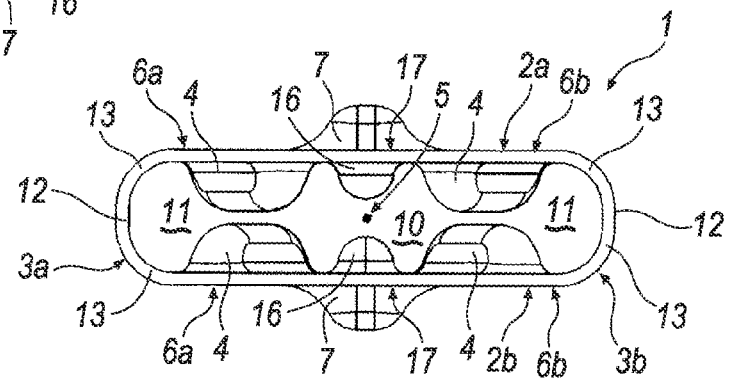
FIG. 6 shows a frontal view of the flat tube shown in FIG. 6.
Figure 7:
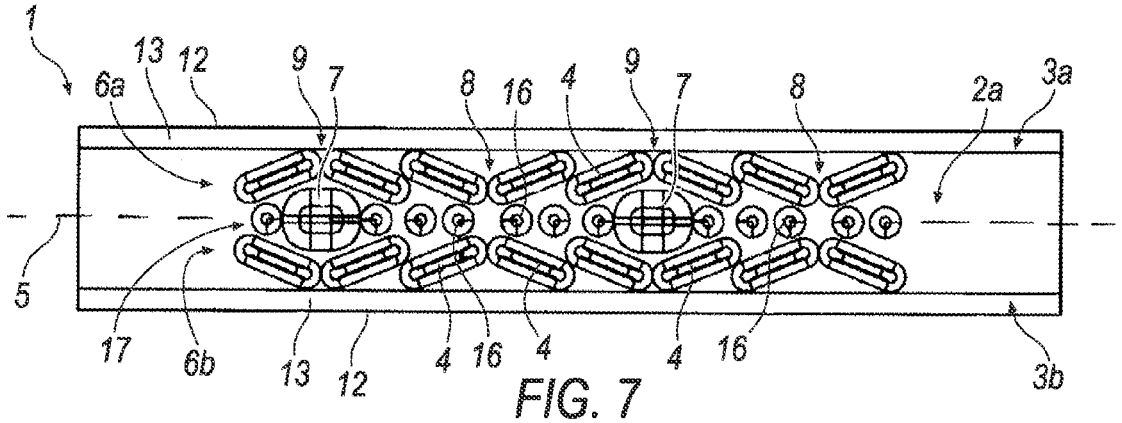
FIG. 7 shows a plan view of the flat tube shown in FIG. 6.
Figure 8:
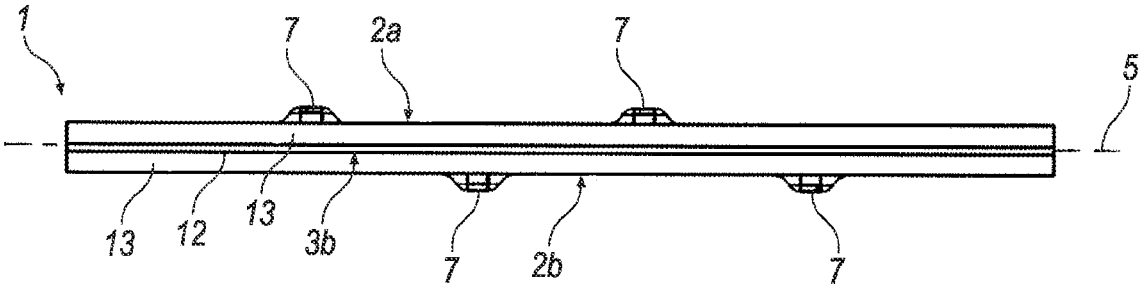
FIG. 8 shows a lateral view of the flat tube shown in FIG. 6.

FIG. 5 shows a perspective view of the flat tube 1 according to the invention, which comprises multiple nub-like mouldings 16 (e.g., nub-shaped mouldings). FIG. 6 to FIG. 8 show lateral views of the flat tube 1 shown in FIG. 5. The nub-like mouldings 16 project into the flat tube 1—which is otherwise moulded as in FIG. 1 to FIG. 4—and are arranged between the two flow rows 6*a* and 6*b* of the turbulence projections 4. Furthermore, the nub-like mouldings 16 are arranged in the longitudinal direction 5 of the flat tube 1 in a row 17 with the support projections 17 one behind the other. The nub-like mouldings 16 project into the flow passage 10 and a flow cross section of the flow passage 10 is reduced. In particular, the exhaust gas cannot flow through the flow passage 10 in an unobstructed manner and is better swirled up and better cooled because of this. The cooling output in the flat tube then corresponds to the cooling output in a rectangular flat tube even without lateral projections. The advantages of the rounded flat tube 1—such as for example a lower coolant requirement for preventing boiling in the exhaust gas cooler—are advantageously retained.

Figure 9:
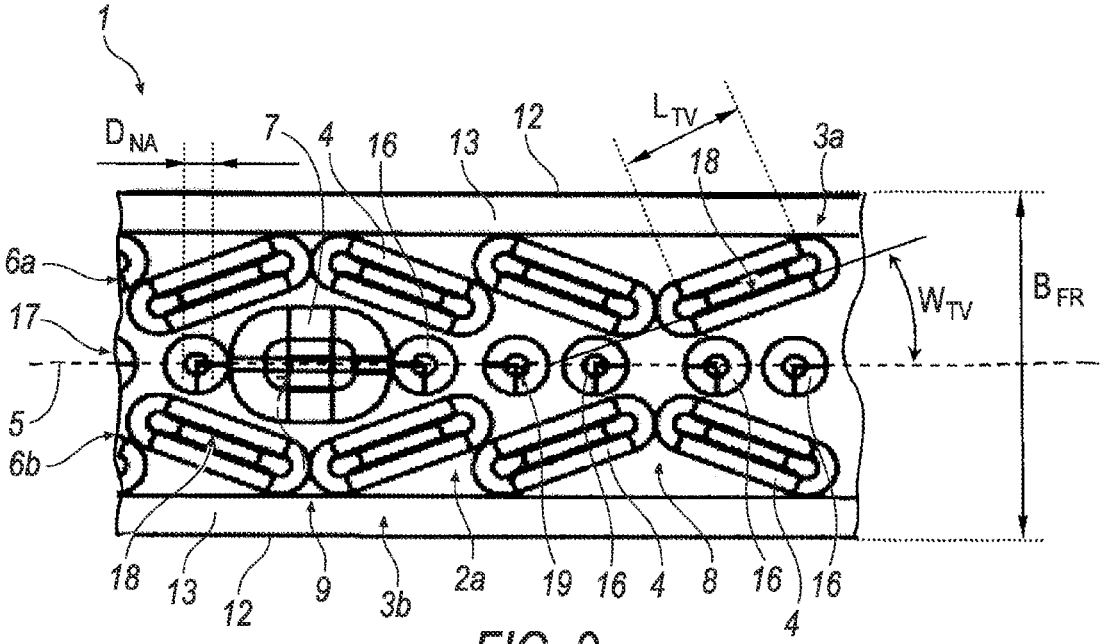
FIG. 9 shows a detail plan view of the flat tube shown in FIG. 6 with geometrical dimensions.
Figure 10:
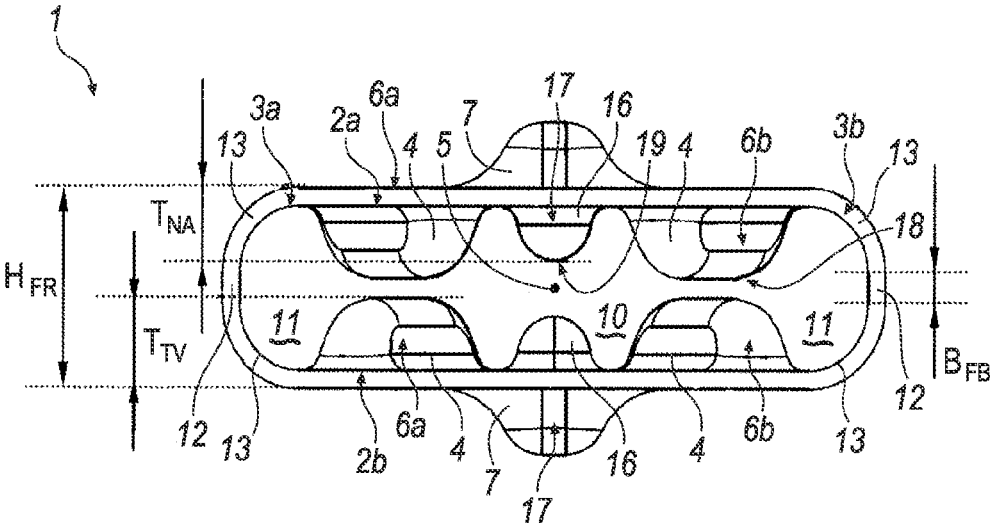
FIG. 10 shows a detail frontal view of the flat tube according to the invention with geometrical dimensions.

FIG. 9 and FIG. 10 show views of the flat tube 1—as is depicted in FIGS. 5 to 8—with geometrical dimensions. The flat tube 1 has a width $B_{FR}$ between 13 mm and 18 mm, preferably between 15 mm and 17 mm. A height $H_{FR}$ of the flat tube 1 is between 3.8 mm and 5 mm, preferably between 4 mm and 4.6 mm. Furthermore, the flat tube 1 can have a wall thickness between 0.34 mm and 0.5 mm, preferably between 0.37 mm and 0.42 mm. A width $B_{FB}$ of the respective flat region 12, which extends perpendicularly to the two wide sides 2*a* and 2*b*, is between 0.5 mm and 0.9 mm, preferably between 0.65 mm and 0.75 mm. A base 18 of the turbulence projections 4 has a length $L_{TV}$ between 3.5 mm and 8 mm, preferably between 5 mm and 6 mm. A depth Try of the turbulence projections 4 is between 0.5 mm and 1.8 mm, preferably between 1.4 mm and 1.6 mm. An angle $W_{TV}$ of the turbulence projections 4 to the longitudinal direction 5 of the flat tube 1 is between 18° and 31°, preferably between 22° and 25°. A substantially semi-spherical base 19 of the nub-like mouldings 16 has a diameter $D_{NA}$ between 0.5 mm and 2 mm, preferably between 0.8 mm and 1.5 mm. Furthermore, the nub-like mouldings 16 have a depth $T_{NA}$ between 0.5 mm and 1.8 mm, preferably between 1.0 mm and 1.5 mm.

Figure 11:
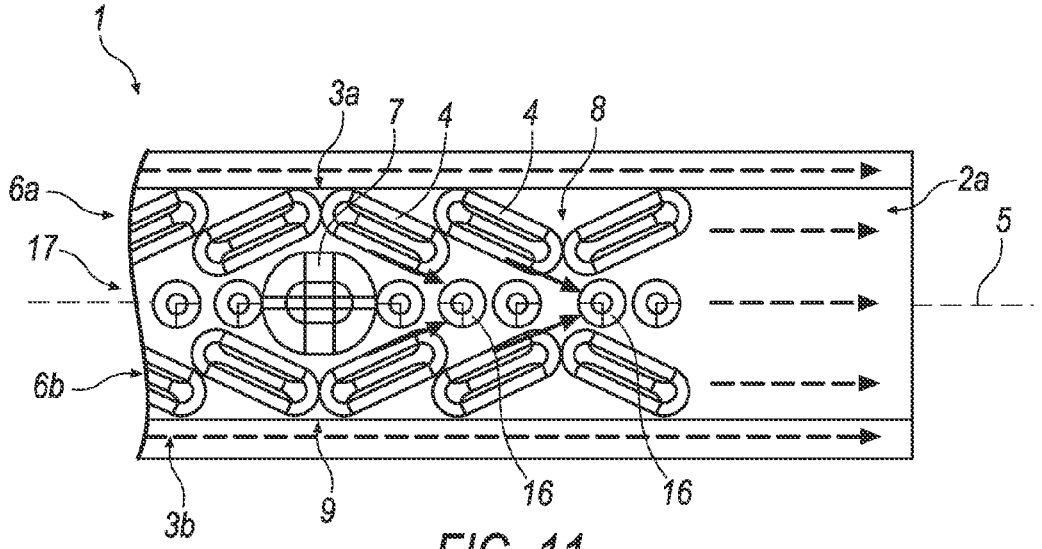
FIGS. 11 and 12 show flow patterns in a flat tube that is symmetrical to the longitudinal direction with opposing flows.
Figure 12:
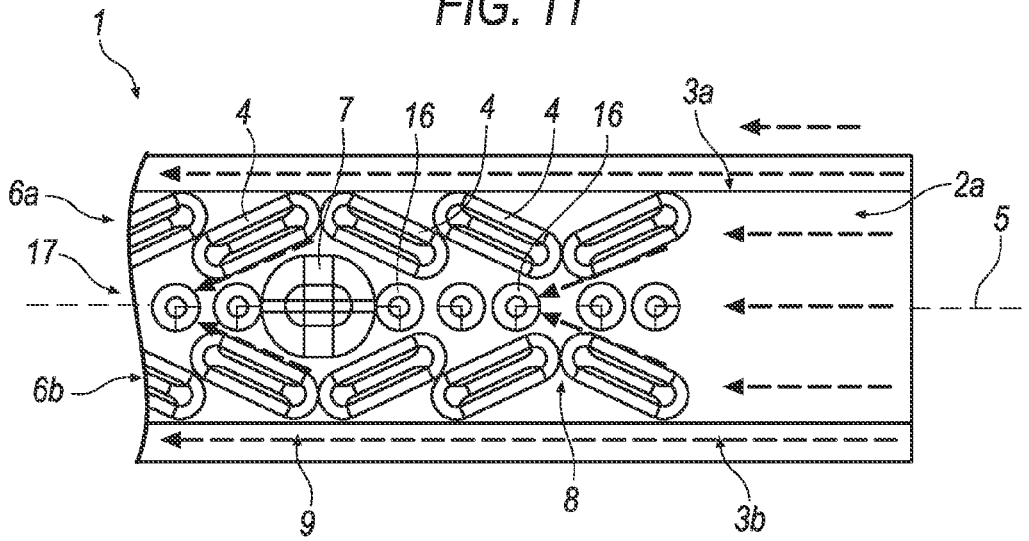

FIG. 11 and FIG. 12 show flow patterns in the flat tube 1 with the multiple nub-like mouldings 16—as depicted in FIG. 5 to FIG. 10—with opposing flows, which are indicated by interrupted arrows. Here, the turbulence projections 4 are arranged in the respective wide side 2*a* or 2*b* in the longitudinal direction 5 into the x-shaped arrangements 8 and into the o-shaped arrangements 9, which are formed symmetrically to the longitudinal direction 5 of the flat tube 1. The x-shaped arrangements 8 conduct the exhaust gas in an inflow direction first half from the narrow sides 3*a* and 3*b* into the middle of the flat tube 1 and in an inflow direction second half from the middle of the flat tube 1 to the narrow sides 3*a* and 3*b*. The o-shaped arrangements 9 conducts the exhaust gas in an inflow direction first half from the middle of the flat tube 1 to the narrow sides 2*a* and 2*b* and in an inflow direction second half from the narrow sides 3*a* and 3*b* into the middle of the flat tube 1. Furthermore, the nub-like mouldings 16 are specifically subjected to the onflow of exhaust gas so that the exhaust gas in the flat tube 1 is mixed through better and because of this also cooled.

Figure 13:
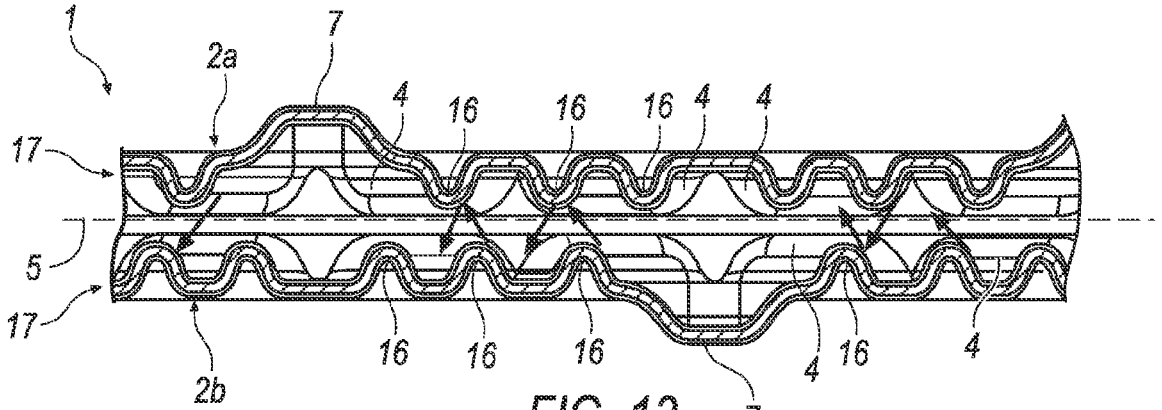
FIG. 13 shows a flow pattern in a flat tube with alternating nub-like mouldings.

FIG. 13 shows a flow pattern in the flat tube 1—as is depicted in FIG. 5 to FIG. 12—through the flow passage 10. The row 17 of the nub-like mouldings 16 in the one wide side 2*a* and the row 17 of the nub-like mouldings 16 in the other wide side 2*b* are located opposite one another and the nub-like mouldings 16 of the two rows 17 alternate in the flow passage 10. In this way, the exhaust gas is conducted from the nub-like mouldings 16 in the one wide side 2*a* or 2*b* specifically to the nub-like mouldings 16 in the other wide side 2*b* or 2*a*, as shown by arrows. Here, an excessive local cross-sectional reduction of the flow passage 10 and an excessive pressure loss in the flat tube 1 are avoided. Advantageously, the cooling output is retained.

Figure 14:
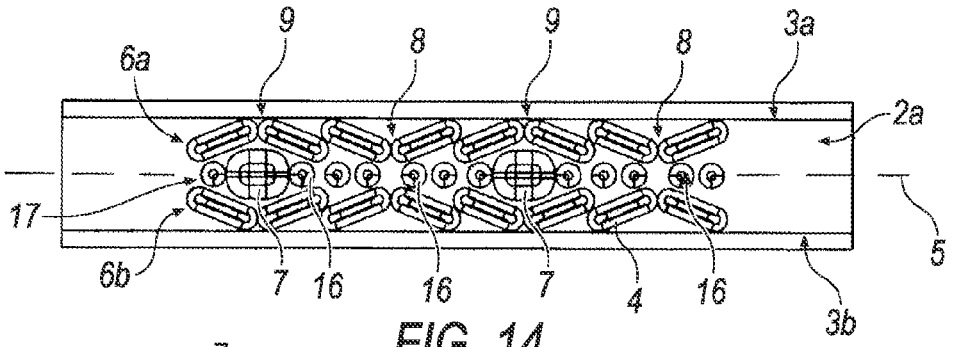
FIGS. 14 to 16 show lateral views of a flow-symmetrical flat tube.
Figure 15:
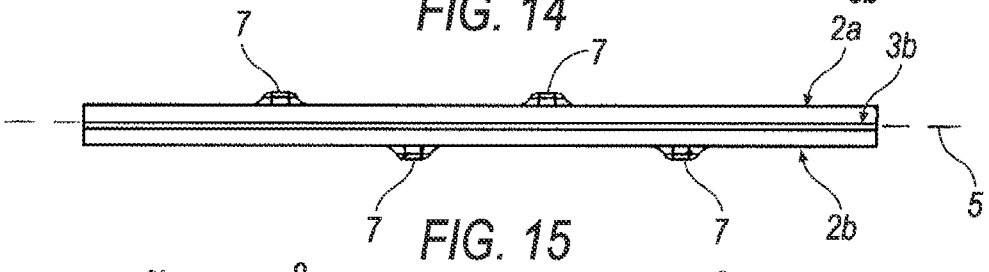
Figure 16:
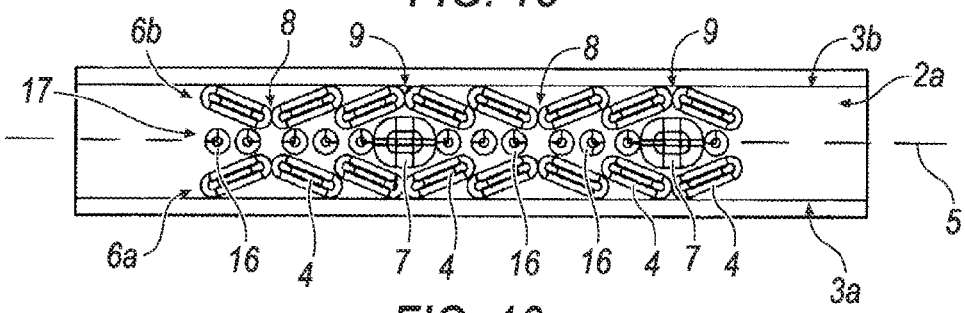
Figure 17:
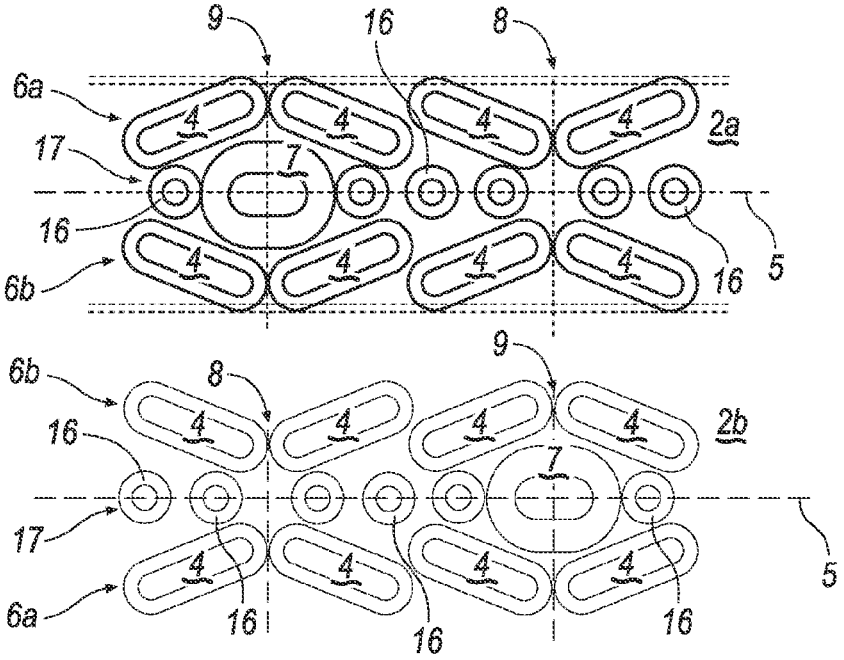
FIG. 17 shows a comparative view of wide sides of a flow-symmetrical flat tube.

FIG. 14 to FIG. 16 show lateral views of the flow-symmetrical flat tube 1, as is also depicted in FIG. 5 to FIG. 13. In FIG. 17, a comparative view of the wide sides 2*a* and 2*b* is shown. As shown in FIG. 17, the one wide side 2*a* or 2*b* corresponds to the other wide side 2*b* or 2*a* that is mirrored perpendicularly (i.e., non-reverse mirrored, flip mirrored) relative to the longitudinal direction 5. As already shown in FIG. 13, the nub-like mouldings in the wide sides 2*a* and 2*b* also alternate in the longitudinal direction 5. Furthermore, the x-shaped arrangements 8 and the o-shaped arrangements 9 also alternate on the respective wide sides 2*a* and 2*b* in the longitudinal direction 5 and are located opposite one another on the wide sides 2*a* and 2*b*. In this way, an excessive cross-sectional reduction of the flat tube 1 between the wide sides 2*a* and 2*b* and an excessive pressure loss in the flat tube 1 can be advantageously avoided. Because of the flow-symmetrical flat tube 1, the exhaust gas cooler can be produced in a simplified manner, since no additional orientation of the flat tube 1 to the exhaust gas flow in the exhaust gas cooler is necessary.

Altogether, producing the flat tube 1 according to the invention can be substantially simplified. Furthermore, the flat tube 1 according to the invention has a high pressure stability even with large manufacturing tolerances. Because of the nub-like mouldings 16 in the flat tube 1, the flow passage 10 between the two flow rows 6*a* and 6*b* of the turbulence projections 4 can be reduced, furthermore, and because of this the cooling output of the exhaust gas cooler increased.

The invention claimed is:

1. A flat tube for an exhaust gas cooler, comprising:

a central longitudinal axis extending in a longitudinal direction;

two flat wide sides extending parallel to one another along a longitudinal direction and disposed opposite one another;

two rounded narrow sides that are narrower than the two wide sides, the two narrow sides extending parallel to one another along the longitudinal direction and disposed opposite one another;

the two wide sides including a plurality of moulded turbulence projections projecting from a respective one of the two wide sides toward the other of the two wide sides, the plurality of turbulence projections respectively structured in an elongated manner and arranged at an angle relative to the longitudinal direction;

the plurality of turbulence projections arranged on the two wide sides in two flow rows extending parallel to the longitudinal direction;

a plurality of moulded support projections projecting from a respective one of the two wide sides away from the other of the two wide sides, the plurality of support projections arranged between the two flow rows;

wherein each narrow side of the two narrow sides has an elongated flat region extending in the longitudinal direction along essentially the entire length of the respective narrow side and arranged perpendicularly to the two wide sides in a respective middle of the narrow side; and wherein the flat region merges into the two wide sides via a plurality of rounded corner regions of the narrow side.

2. The flat tube according to claim 1, wherein at least one of:

a length of the flat region corresponds to a length of the narrow side; and a width of the flat region perpendicular to the longitudinal direction and the two wide sides is 0.5 mm to 0.9 mm.

3. The flat tube according to claim 1, wherein the two wide sides include a plurality of nub-shaped mouldings projecting from a respective one of the two wide sides toward the other of the two wide sides, the plurality of nub-shaped mouldings arranged between the two flow rows and, in the longitudinal direction, are arranged in a row one behind the other.

4. The flat tube according to claim 3, wherein:

the row of the plurality of nub-shaped mouldings on one of the two wide sides and the row of the plurality of nub-shaped mouldings on the other of the two wide sides are arranged opposite one another; and at least some of the plurality of nub-shaped mouldings in the row on the one of the two wide sides are arranged in an alternating manner with at least some of the plurality of nub-shaped mouldings in the row on the other of the two wide sides in the longitudinal direction.

5. The flat tube according to claim 3, wherein at least one of:

a substantially semi-spherical base of at least some of the plurality of nub-shaped mouldings has a diameter of 0.5 mm to 2 mm; and at least some of the plurality of nub-shaped mouldings have a depth of 0.5 mm to 1.8 mm.

6. The flat tube according to claim 3, wherein:

the plurality of nub-shaped mouldings and the plurality of support projections are both arranged in the row; and the row of the plurality of nub-shaped mouldings and the plurality of support projections are arranged, relative to a direction perpendicular to the longitudinal direction, in a middle of a respective wide side of the two wide sides.

7. The flat tube according to claim 3, wherein at least one of:

a substantially semi-spherical base of at least some of the plurality of nub-shaped mouldings has a diameter of 0.8 mm to 1.5 mm; and at least some of the plurality of nub-shaped mouldings have a depth of 1.0 mm to 1.5 mm.

8. The flat tube according to claim 1, wherein at least one of:

a base of the plurality of turbulence projections has a length of 3.5 mm to 8 mm; and the plurality of turbulence projections have a depth of 0.5 mm to 1.8 mm.

9. The flat tube according to claim 1, wherein the angle of the plurality of turbulence projections relative to the longitudinal direction is 18° to 31°.

10. The flat tube according to claim 9, wherein the plurality of turbulence projections, on a respective wide side in the longitudinal direction, are arranged in an x-shaped arrangement and in at least one o-shaped arrangement.

11. The flat tube according to claim 10, wherein:

the x-shaped arrangement and the at least one o-shaped arrangement on the respective wide side are arranged in an alternating manner with one another in the longitudinal direction; and the x-shaped arrangement of one of the two wide sides is disposed opposite the at least one o-shaped arrangement of the other of the two wide sides.

12. The flat tube according to claim 11, wherein the plurality of support projections are arranged within the at least one o-shaped arrangement of the respective wide side.

13. The flat tube according to claim 1, wherein the flat tube is configured flow-symmetrically, and wherein one of the two wide sides corresponds to the other of the two wide sides that is mirrored perpendicularly to the longitudinal direction.

14. The flat tube according to claim 1, wherein the angle of the plurality of turbulence projections relative to the longitudinal direction is 22° to 25°.

15. The flat tube according to claim 1, wherein the two narrow sides each have a cross-sectional profile lying perpendicular to the longitudinal direction that is defined by the flat region and the plurality of rounded corner regions.

16. The flat tube according to claim 1, wherein the flat region merges directly into the two wide sides via the plurality of rounded corner regions.

17. A flat tube for an exhaust gas cooler, comprising:

two planar wide sides respectively coupled to two rounded narrow sides defining a flow passage having a central longitudinal axis extending in a longitudinal direction, the two wide sides extending parallel to one another along the longitudinal direction and disposed opposite one another, the two narrow sides extending parallel to one another along the longitudinal direction and disposed opposite one another;

a plurality of moulded turbulence projections arranged on each of the two wide sides in two flow rows extending parallel to the longitudinal direction, the plurality of turbulence projections projecting into the flow passage and respectively structured in an elongated manner extending at an angle relative to the longitudinal direction; and a plurality of moulded support projections arranged on each of the two wide sides between the two flow rows and projecting away from the flow passage;

wherein each of the two narrow sides has two rounded corner regions and an elongated planar region disposed between the two rounded corner regions, the planar region extending in the longitudinal direction along essentially the entire length of the respective narrow side and lying perpendicular to the two wide sides;

wherein the two narrow sides are narrower than the two wide sides; and wherein the planar region merges directly into the two wide sides via the two rounded corner regions.

18. The flat tube according to claim 17, further comprising a plurality of nub-shaped mouldings arranged in a row with the plurality of support projections between the two flow rows on each of the two wide sides and projecting into the flow passage.

19. The flat tube according to claim 17, wherein:

a subset of the plurality of turbulence projections on each of the two wide sides are arranged to define a plurality of x-shaped arrangements, and another subset of the plurality of turbulence projections on each of the two wide sides are arranged to define a plurality of o-shaped arrangements;

the plurality of x-shaped arrangements and the plurality of o-shaped arrangements are disposed along each of the two wide sides in an alternating relationship with one another in the longitudinal direction; and the plurality of support projections are arranged within the plurality of o-shaped arrangements.

20. The flat tube according to claim 17, wherein the two narrow sides each have a cross-sectional profile lying perpendicular to the longitudinal direction that is defined by the planar region and the two rounded corner regions.

* * * * *